US006910491B2

(12) United States Patent
Wu

(10) Patent No.: US 6,910,491 B2
(45) Date of Patent: Jun. 28, 2005

(54) GOLF UMBRELLA CASE SUITABLE FOR POSITIONING IN A GOLF BAG

(76) Inventor: Tsun-Zong Wu, PO Box 82-144, Taipei (TW)

( * ) Notice: Subject to any disclaimer, the term of this patent is extended or adjusted under 35 U.S.C. 154(b) by 0 days.

(21) Appl. No.: 10/338,869

(22) Filed: Jan. 9, 2003

(65) Prior Publication Data

US 2004/0134528 A1 Jul. 15, 2004

(51) Int. Cl.[7] ..... A45B 25/24
(52) U.S. Cl. ..... 135/34.2
(58) Field of Search ..... 206/315.6, 315.2, 206/315.3; 135/34.2, 18, 25.41, 31, 33.5; 248/96

(56) References Cited

U.S. PATENT DOCUMENTS 2,595,987 A * 5/1952 Shears ..... 206/315.6
2,806,711 A * 9/1957 Jacobs ..... 280/47.19
3,935,874 A * 2/1976 Cohen ..... 135/16
4,522,300 A * 6/1985 Hamblet ..... 206/315.4
5,297,570 A * 3/1994 Conner ..... 135/16
5,353,977 A * 10/1994 Schiro et al. ..... 224/251
6,047,822 A * 4/2000 Batten ..... 206/315.6
6,199,819 B1 * 3/2001 Churillo ..... 248/540
6,263,891 B1 * 7/2001 Hartwell et al. ..... 135/33.2
6,375,004 B1 * 4/2002 Tuerschmann et al. .. 206/315.6
6,581,736 B1 * 6/2003 Scicluna ..... 190/109

* cited by examiner

*Primary Examiner*—Korie Chan
*Assistant Examiner*—Kofi Schulterbrandt
(74) *Attorney, Agent, or Firm*—Leong C. Lei

(57) ABSTRACT

A golf umbrella case is designed for positioning in a golf bag between two transverse partitioning strips at a top opening of the golf bag for receiving a golf umbrella therein, so that the golf bag has an integral and valuable appearance without an outward protruded portion to collide or interfere with external things and cause discomfort to a person carrying the golf bag on shoulder. Any rainwater remained on the golf umbrella is collected in the golf umbrella case without internally wetting the golf bag, and the golf umbrella case may be easily removed from the golf bag to clear rainwater and dust accumulated therein.

3 Claims, 7 Drawing Sheets

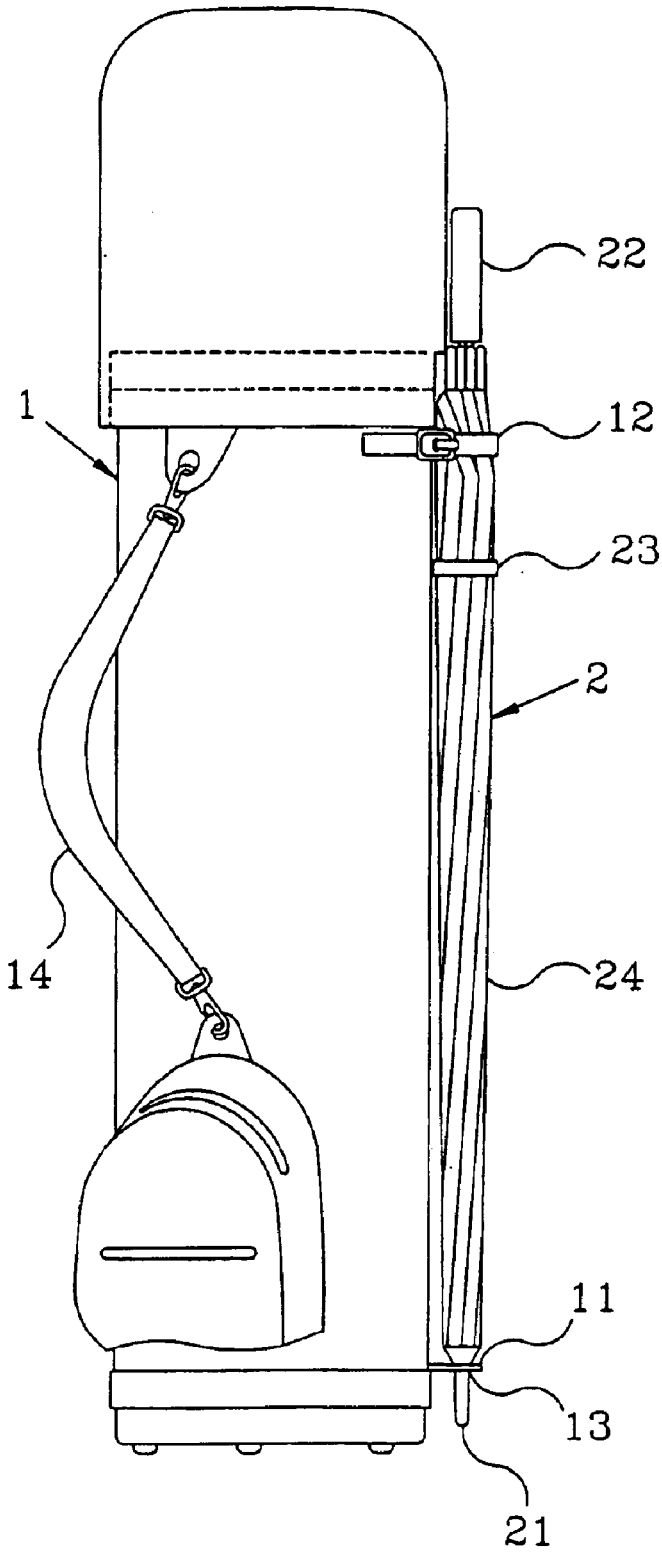
FIG.1 (PRIOR. ART)

GOLF UMBRELLA CASE SUITABLE FOR POSITIONING IN A GOLF BAG

FIELD OF THE INVENTION

The present invention relates to a golf umbrella case that is specially designed for positioning in a golf bag to keep an integral appearance of the golf bag and prevent the golf bag from being internally wetted by rainwater remained on a golf umbrella positioned therein.

BACKGROUND OF THE INVENTION

It is very possible to have sudden changes in the weather during a formal or a practice golf game that usually takes a considerably long time to complete. In the wide and open golf link, it is almost impossible to timely take shelter from the rain. Therefore, a golfer would usually prepare a golf umbrella to be carried along with the golf bag. In case of sudden changes in the weather, the caddie carrying the golf bag for the golfer may quickly get the golf umbrella for use. The golf umbrella may also be used as a shelter from the sun.

FIG. 1 shows a conventionally structured golf bag 1. As shown, the golf bag 1 is provided at one side close to a bottom and a top thereof with outward protruded holding plate 11 and fastening strap 12, respectively. The holding plate 11 includes an insertion hole 13. A conventionally structured golf umbrella 2 is held to the golf bag 1 by inserting a ferrule 21 of the golf umbrella 2 into the insertion hole 13 on the holding plate 11 and tightening the golf umbrella 2 at a position close to a handle 22 of the golf umbrella with the fastening strap 12, so that the golf umbrella 2 is externally attached to the golf bag 1. The following disadvantages are found in the above-described manner of binding the golf umbrella 2 to the golf bag 1:

1. The golf umbrella 2 is held to an outer side of the golf bag 1 to spoil an integral appearance and reduce the valuable quality of the golf bag.
2. The golf umbrella 2 forms on the outer side of the golf bag 1 a long protruded portion that together with the holding plate 11 tend to collide or interfere with other things to damage the latter or to injure other people's hands when the golf bag 1 is positioned along with many other articles during conveyance thereof.
3. The golf umbrella 2 is usually attached to the outer side of the golf bag 1 at a position counterclockwise to the right of a shoulder strap 14 of the golf bag 1 to space from the shoulder strap 14 by an angle about 90 degrees. When a caddie carries the golf bag 1 on his or her left shoulder, the golf umbrella 2 located at such a position tends to press against the caddie's body to cause discomfort to the caddie. To avoid such discomfort, the caddie would usually carry the golf bag 1 on his or her right shoulder for the golf umbrella 2 to face outward relative to the caddie's body. However, the caddie's right shoulder would become tired and sore after carrying the golf bag 1 for a prolonged time.

SUMMARY OF THE INVENTION

It is therefore a primary object of the present invention to provide a golf umbrella case that is suitable for positioning in a golf bag to eliminate the drawbacks caused by attaching the conventionally structured golf umbrella to the outer side of the golf bag.

To achieve the above and other objects, the golf umbrella case of the present invention is adapted to locate in place between two transverse strips at a top opening of the golf bag for holding a golf umbrella therein, so that the golf bag may have an integral and valuable appearance without an outward protruded portion to collide or interfere with external things and cause discomfort to a caddie carrying the golf bag on shoulder.

Moreover, the golf umbrella case may collect any rainwater remained on the golf umbrella to avoid an internally wetted golf bag, and may be easily removed from the golf bag to clear rainwater and dust accumulated therein.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein FIG. 1 shows a conventional golf bag with means for externally attaching a golf umbrella to the golf bag;

DETAILED DESCRIPTION OF THE PREFERRED EMBODIMENTS

Figure 3:
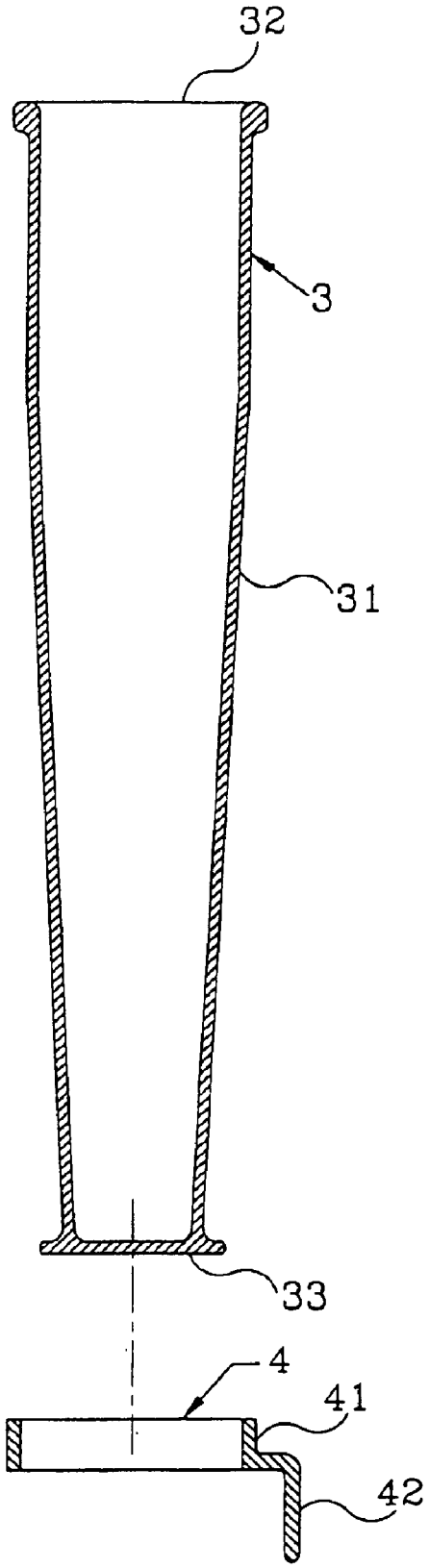
FIG. 3 is an exploded sectional view of FIG. 2.
Figure 2:
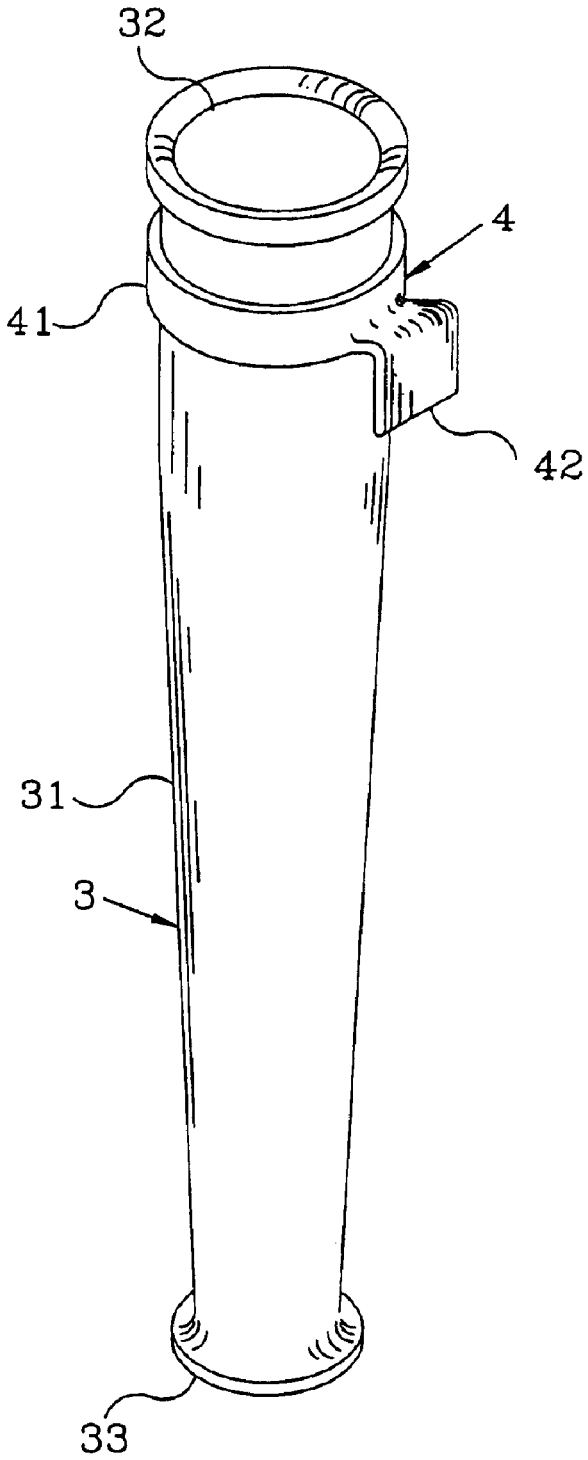
FIG. 2 is a perspective view of a golf umbrella case suitable for positioning in a golf bag according to the present invention, with a locating ring assembled thereto.

Please refer to FIG. 2 that is a perspective view of a golf umbrella case 3 suitable for positioning in a golf bag according to the present invention, with a locating ring 4 assembled thereto, and to FIG. 3 that is an exploded sectional view of FIG. 2.

As shown, the golf umbrella case 3 includes a downward tapered hollow body 31 having a top opening 32 and a closed bottom plate 33.

Figure 5:
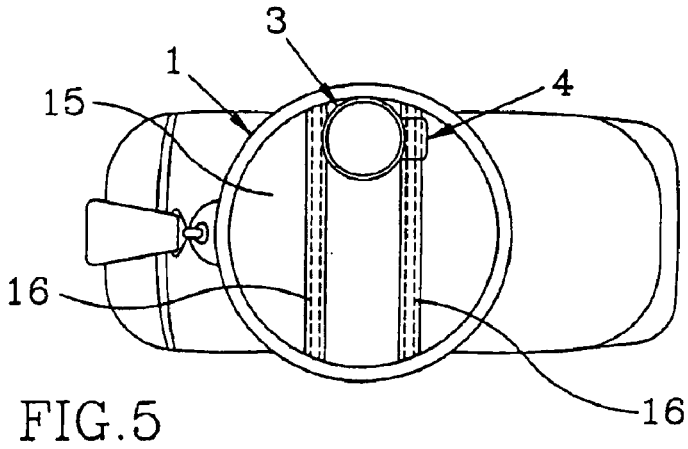
FIG. 5 is a top view of FIG. 4.
Figure 4:
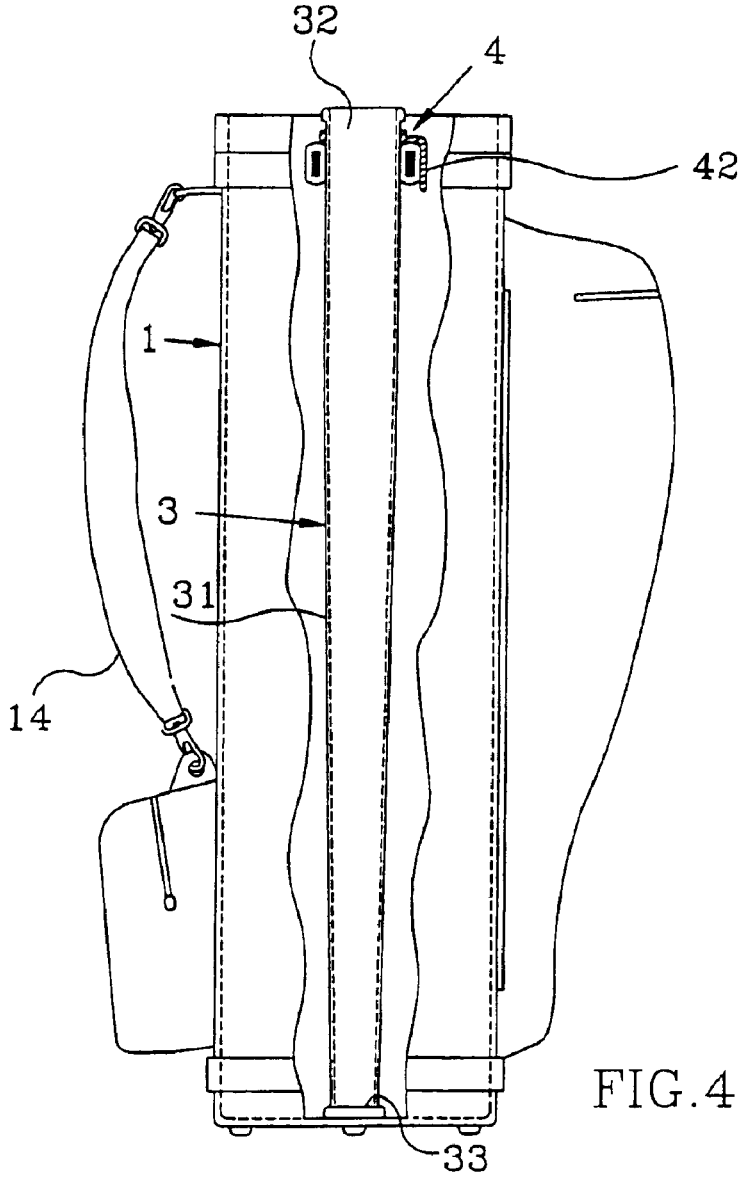
FIG. 4 is a partially sectioned side view of a golf bag with the golf umbrella case and the locating ring of FIG. 2 positioned therein.

The golf umbrella case 3 may be positioned in a golf bag 1, as shown in FIG. 4 that is a partially sectioned view of the golf bag 1. Please also refer to FIG. 5 that is a top view of FIG. 4. The golf bag 1 is generally provided at a top opening 15 with two transverse partitioning strips 16 spaced from each other by a predetermined distance to divide an internal space of the golf bag 1 into three smaller rooms. As can be seen from FIG. 9, golf clubs 17 are put in different rooms of the golf bag 1 according to their lengths, so that the golf clubs 17 can be easily identified and quickly removed from the golf bag 1. The partitioning strips 16 also prevent the golf clubs 17 from overly inclining in the golf bag 1 due to an overlarge top opening 15 of the golf bag 1. The golf umbrella case 3 is positioned in the golf bag 1 by inserting it into the middle room between the two partitioning strips 16, so that the two partitioning strips 16 properly clamp and thereby locate the golf umbrella case 3 in place in the golf bag 1.

The locating ring 4 is adapted for assembling to an outer circumferential surface of the golf umbrella case 3, and includes a ring portion 41 and at least one L-shaped lug 42 outward and downward projected from one side of the ring portion 41. The ring portion 41 is designed for putting on the outer surface of the golf umbrella case 3 with a lower edge rested on top edges of the two partitioning strips 16 to straddle the middle room, and the lug 42 is adapted to rest on one of the two partitioning strips 16 to firmly clamp an upper edge of the partitioning strip 16 between the ring portion 41 and the lug 42. These arrangements enable the golf umbrella case 3 to stably locate in the golf bag 1 between the two partitioning strips 16.

Figure 6:
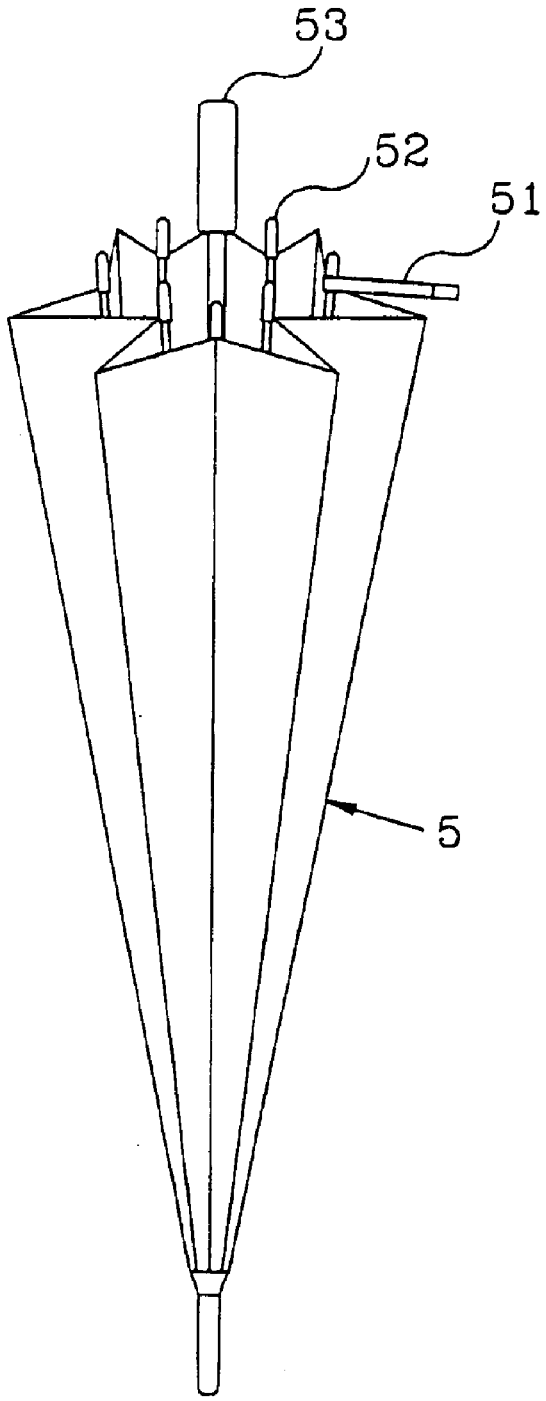
FIG. 6 is a perspective view of a first example of golf umbrella suitable for positioning in the golf umbrella case according to the present invention.
Figure 7:
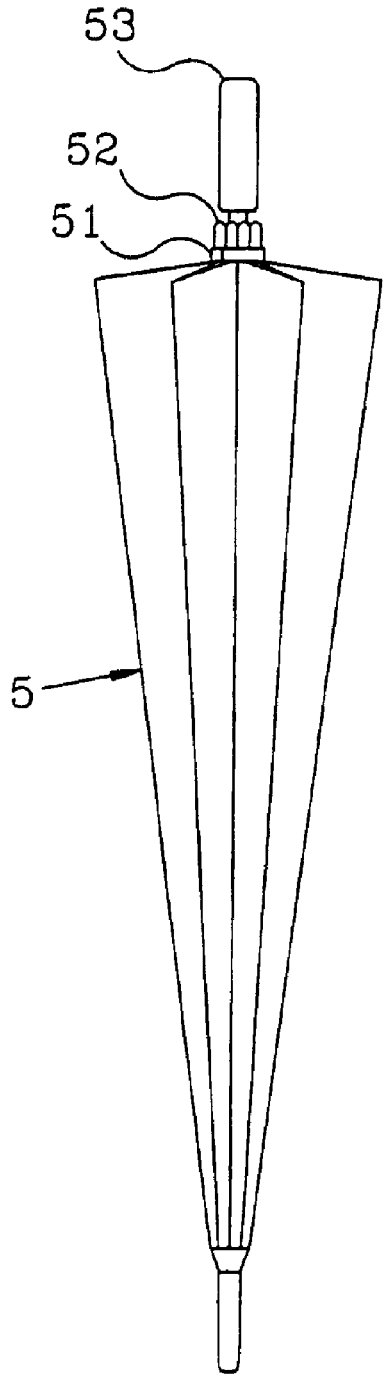
FIG. 7 shows the golf umbrella of FIG. 6 in a fully closed state.

Please now refer to FIG. 6 that is a perspective view of a first example of golf umbrella 5 suitable for positioning in the golf umbrella case 3 of the present invention, and to FIG. 7 that shows the golf umbrella 5 of FIG. 6 in a fully closed state.

As shown in FIG. 1, a common golf umbrella 2 usually includes a tying strip 23 having a uniform width connected to a cover 24 of the golf umbrella 2. When the tying strip 23 is tightened around the closed cover 24, it is in a transverse position perpendicular to a centerline of the golf umbrella 2. The tying strip 23 tends to prevent the golf umbrella 2 from smoothly inserting into a golf umbrella case, such as the golf umbrella case 3 of the present invention. On the other hand, the first example of golf umbrella 5 shown in FIG. 6 includes a tying strip 51 that is connected to a distal end 52 of one of many ribs of the golf umbrella 5. The tying strip 51 provided at the above-mentioned position does not interfere the fully closed golf umbrella 5 from smoothly inserting into or removing from the golf umbrella case 3.

Figure 8:
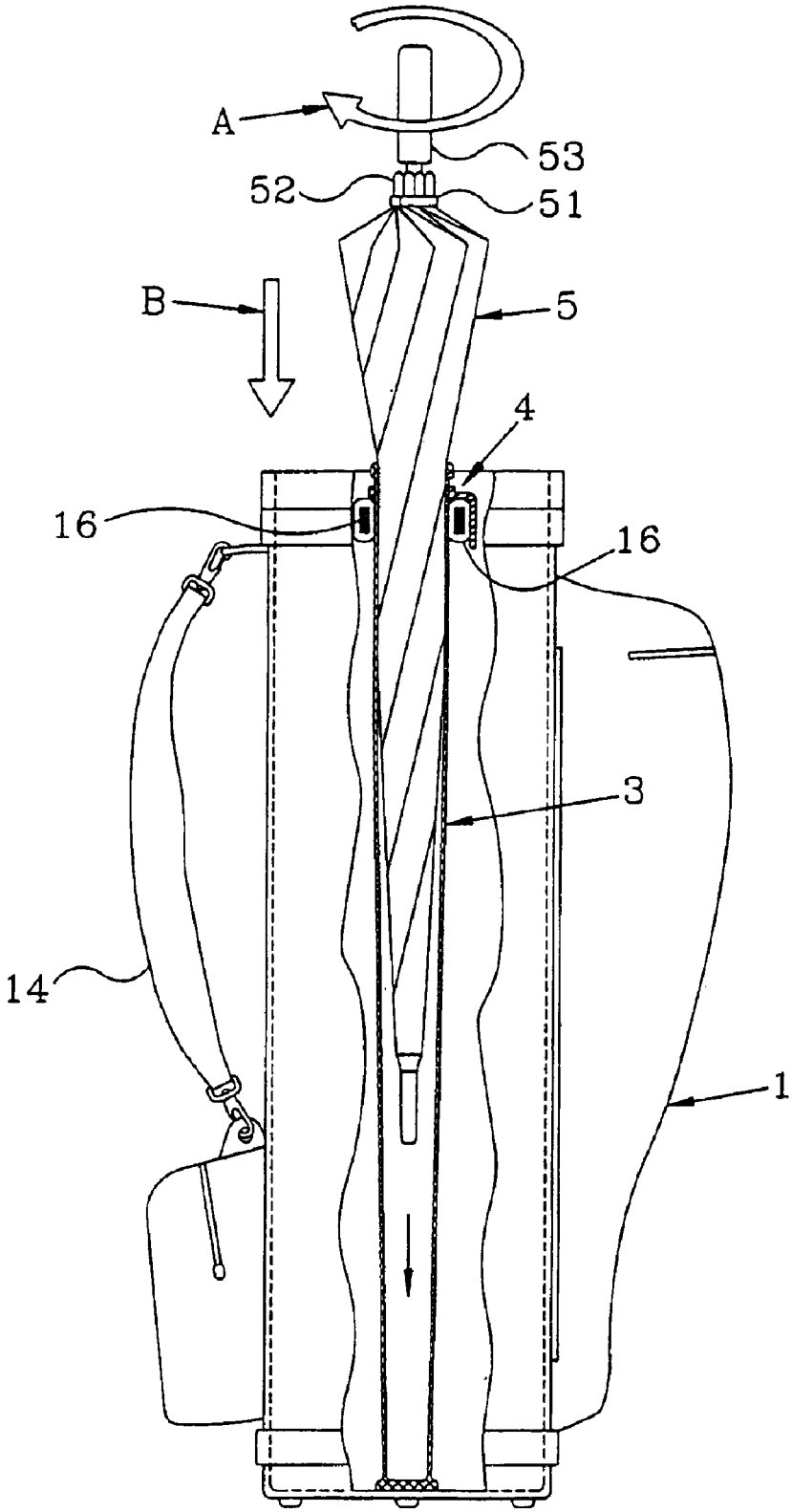
FIG. 8 shows the manner of inserting the golf umbrella of FIG. 7 into the golf umbrella case positioned in the golf bag.
Figure 9:
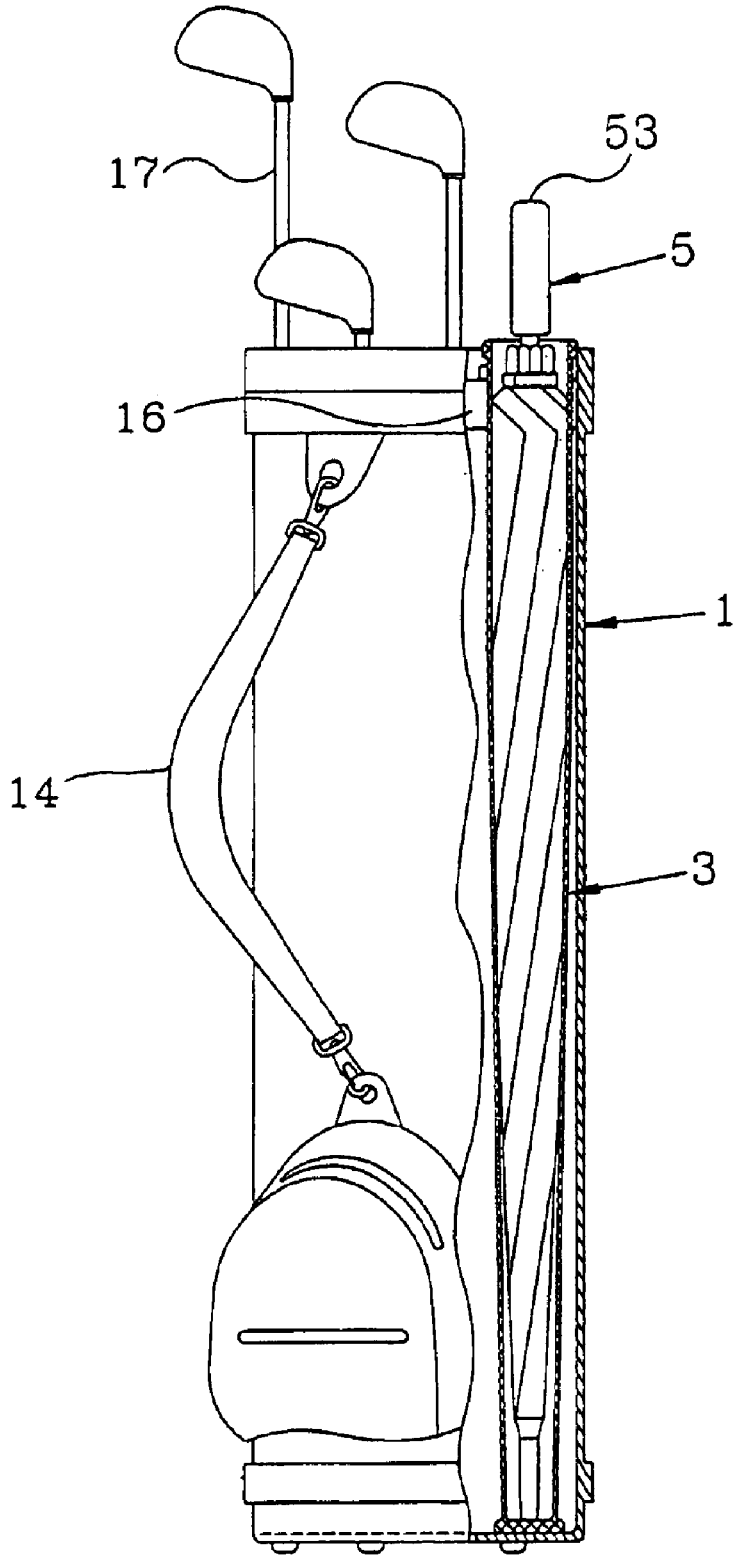
FIG. 9 is a partially sectioned side view showing the golf umbrella of FIG. 7 has been fully inserted into the golf umbrella case positioned in the golf bag.

Please refer to FIG. 8 that shows the manner of inserting the golf umbrella 5 into the golf umbrella case 3. To do so, first bind the ribs of the golf umbrella 5 together with the tying strip 51. Then, wind collapsed gores of the golf umbrella 5 in a normal way and turn the golf umbrella 5 clockwise, as indicated by the arrow A in FIG. 8, while downward push the golf umbrella 5, as indicated by the arrow B, so that the whole golf umbrella 5 is smoothly inserted into the golf umbrella case 3. A handle 53 of the golf umbrella 5 inserted into the golf umbrella case 3 is upward projected from the top opening 32 of the golf umbrella case 3, as shown in FIG. 9. To remove the golf umbrella 5 from the golf bag 1, simply grip the handle 53 with one hand and the golf umbrella case 3 with the other hand to separate the golf umbrella 5 from the case 3.

Figure 10:
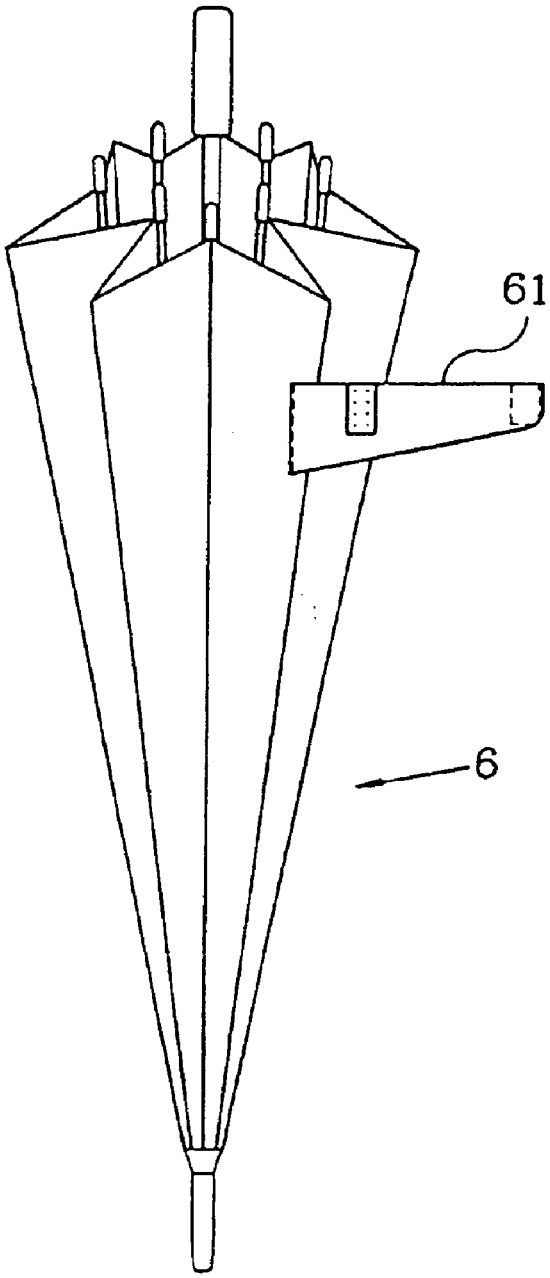
FIG. 10 is a perspective view of a second example of golf umbrella suitable for positioning in the golf umbrella case according to the present invention.
Figure 11:
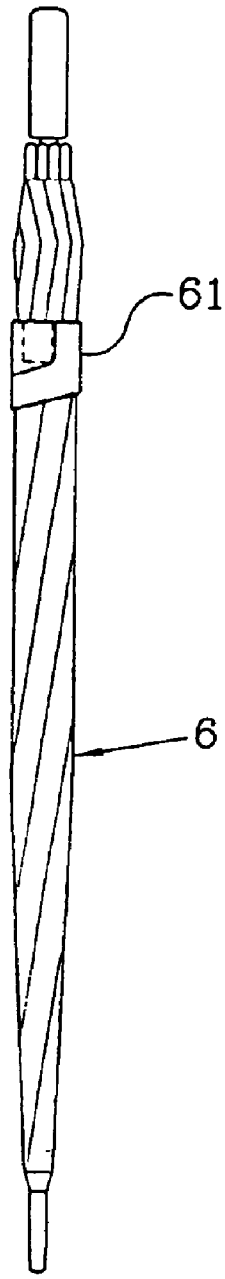
FIG. 11 is a perspective view of the golf umbrella of FIG. 10 in a fully closed state and tightened with a tying strip.

FIG. 10 is a perspective view of a second example of golf umbrella 6 suitable for positioning in the golf umbrella case 3 according to the present invention; and FIG. 11 is a perspective view of the golf umbrella 6 in a fully closed state and tightened with a tying strip.

The second example of golf umbrella 6 includes a tying strip 61 connected to a cover thereof. The tying strip 61 has an inclined front edge giving the tying strip 61 a variable width gradually decreased from inner end toward outer end. After the tying strip 61 is wound around the cover of the golf umbrella 6 to tighten the latter, the inclined front edge of the tying strip 61 forms a spiral that does not significantly protrude from the cover and tends to spirally guide the golf umbrella 6 into the golf umbrella case 3 instead of forming a hindrance to prevent the golf umbrella 6 from smoothly inserting into the golf umbrella case 3.

With the golf umbrella case 3 positioned in the golf bag 1 and the golf umbrella 5 or 6 inserted in the golf umbrella case 3, the golf bag 1 has an integral and valuable appearance. No protruded portion is presented on the golf bag 1 to collide or interfere with other articles or cause discomfort to a caddie carrying the golf bag 1 on shoulder. The golf umbrella case 3 also serves to collect any rainwater remained on the cover of the golf umbrella 5 or 6 received in the case 3, in order to avoid an internally wetted golf bag 1. Moreover, the golf umbrella case 3 can be easily removed from the golf bag 1 to clear any rainwater or dust accumulated therein.

What is claimed is:

1. A golf bag with a golf umbrella case, comprising a downward tapered hollow body having a top opening and a closed bottom plate, and being adapted to insert into said golf bag for receiving a golf umbrella therein, said golf bag including a top opening having two transverse partitioning strips connected thereto, said golf umbrella case being positioned in said golf bag between said two partitioning strips to be clamped therebetween and therefore located in place in said golf bag, a locating ring having a ring portion and a lug outward and downward extended from one side of said ring portion, and said locating ring being adapted to mount on an outer surface of said golf umbrella case at a predetermined position, so that a lower edge of said ring portion is supported on top edges of said two transverse partitioning strips with one of said two partitioning strips clamped between said lug and said ring portion.

2. The golf bag with a golf umbrella case as claimed in claim 1, wherein said golf umbrella includes a plurality of ribs, and a tying strip connected to a distal end of one of said ribs.

3. The golf bag with a golf umbrella case as claimed in claim 1, wherein said golf umbrella includes a tying strip connected to cover of said golf umbrella, said tying strip having an inclined front edge that gives the tying strip a variable width gradually decreased from inner to outer end of the tying strip.

* * * * *